United States Patent [19]

Bång

[11] 4,205,798

[45] Jun. 3, 1980

[54] MACHINE FOR PRODUCING OF LONG CHIPS OF WOOD BY SHEARING STRESSES

[76] Inventor: Erik Börje Bång, Myntvägen 8, Växjö, Sweden

[21] Appl. No.: 907,968

[22] Filed: May 22, 1978

Related U.S. Application Data

[63] Continuation-in-part of Ser. No. 761,861, Jan. 24, 1977, abandoned.

[30] Foreign Application Priority Data

Jan. 30, 1976 [SE] Sweden ..... 7600976
Oct. 13, 1977 [SE] Sweden ..... 7711553

[51] Int. Cl.[2] ..... B02C 18/22
[52] U.S. Cl. ..... 241/224; 144/162 R; 144/176; 144/231; 241/280
[58] Field of Search ..... 241/93, 222–224, 241/242, 277, 280, 282; 144/162 R, 174, 176, 231

[56] References Cited

U.S. PATENT DOCUMENTS

| | | | |
|---|---|---|---|
| 2,710,635 | 6/1955 | Alexander | 241/280 X |
| 3,237,663 | 3/1966 | Kirsten | 144/176 |
| 3,526,259 | 9/1970 | LaPointe | 241/93 X |
| 3,627,213 | 12/1971 | Thumm et al. | 241/280 |
| 3,661,192 | 5/1972 | Nicholson et al. | 241/93 X |
| 3,679,143 | 7/1972 | Montgomery | 241/280 |
| 3,736,967 | 6/1973 | Wood et al. | 144/176 X |
| 3,884,281 | 5/1975 | Pease | 144/162 R X |

*Primary Examiner*—Howard N. Goldberg
*Attorney, Agent, or Firm*—Birch, Stewart, Kolasch & Birch

[57] ABSTRACT

This invention is directed to a chips making machine equipped with at least one wood-working tool including a wood-machining edge on the working tool, which is mounted on the periphery of the rotatable toolholder. The machine is also equipped with a device for feeding the wood against the machining edge. The edge of the wood-working tool is designed for the production of long chips of wood mainly by shearing stresses in layers which are mainly positioned between the wood fibers and are approximately parallel with the direction of the fibers.

6 Claims, 12 Drawing Figures

MACHINE FOR PRODUCING OF LONG CHIPS OF WOOD BY SHEARING STRESSES

CROSS-REFERENCE TO RELATED APPLICATIONS

This application is a Continuation-In-Part of my co-pending application, Ser. No. 761,861, filed Jan. 24, 1977, now abandoned.

BACKGROUND AND SUMMARY OF THE INVENTION

The present invention relates to a machine equipped with at least one wood-working tool and includes a wood-machining edge on the working tool adjacent to the surface of a rotatable tool-holder. The machine is equipped with a device for feeding the wood against the machining edge.

The foremost new and most significant feature of the machine is that its working tool is designed for the production of long chips of wood. The edge of the working tool on the machine for the machining of wood is designed to machine the wood mainly by application of shearing stresses to the layers which are mainly positioned between the wood fibers and are parallel with the direction of the fibers. This edge on the working tool of the machine is designed with a length mainly agreeing with the length of the long chips and the edge is on the whole approximately parallel with the shaft of the tool-holder. The device for feeding the wood is designed to feed the wood against the edge on the working tool of the machine, with the direction of the wood fibers mainly parallel to the shaft of the tool-holder.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The machine design shown in FIGS. 1–6 has been developed as a test machine for the production of test results for the later construction of the machine of the present invention shown in FIGS. 7–9. The test results are presented in the enclosed table.

Figure 1:
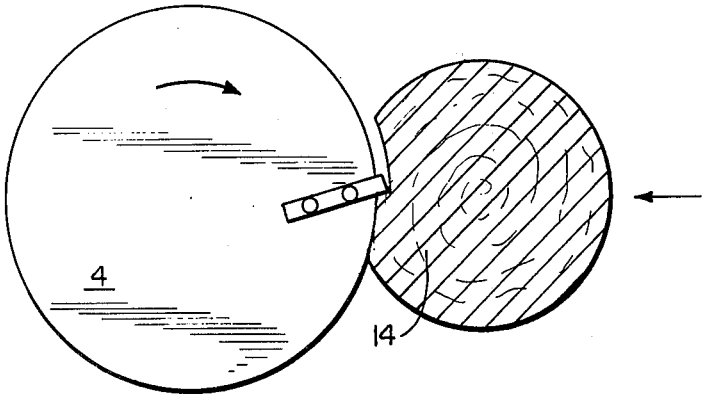
FIG. 1 shows a section along line A—A of FIG. 2 illustrating how a log is fed against a tool-holder in the present invention.
Figure 2:
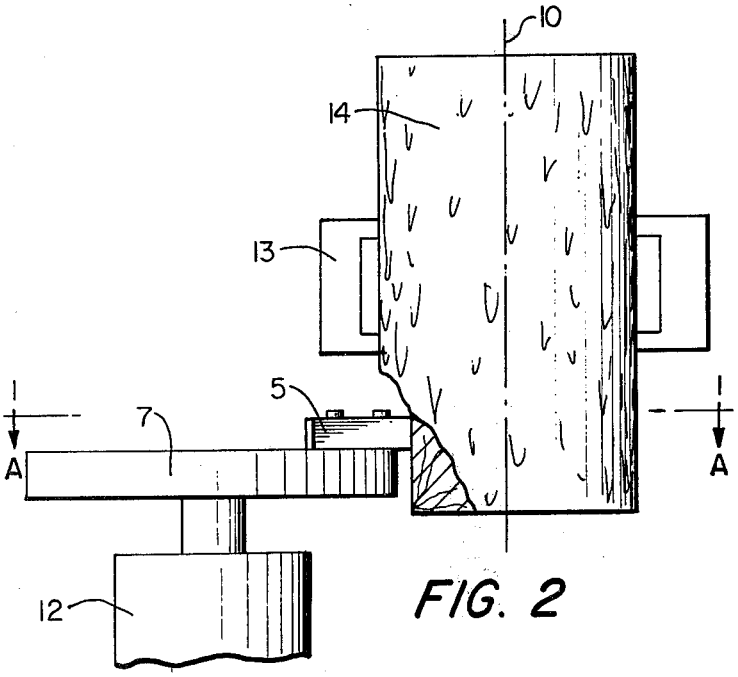
FIG. 2 is a plan view of the machine according to FIG. 1.

The test machine according to the present invention, is shown in FIGS. 1–2 to include a flat disc 7 which forms a tool-holder 4. The machine is equipped with a working tool 5, which is mounted on a spindle 12 of an ordinary capstan lathe. The wood 14, from which the shreds of long chips are produced, is fastened to the cross-slide table 13, and is moved corresponding to the tool movement of the lathe. The wood 14, can consist of a plank or a round log. The center line of the wood is indicated by the reference line 10.

The log 14 is conveyed towards the flat disc 7 by means of the table 13. The table 13 is arranged in the same way as a cross-slide in an ordinary capstan lathe. Thus, the table 13 can be forwarded towards the disc 7. The log 14 is clamped to the table 13 in any suitable way.

Figure 3:
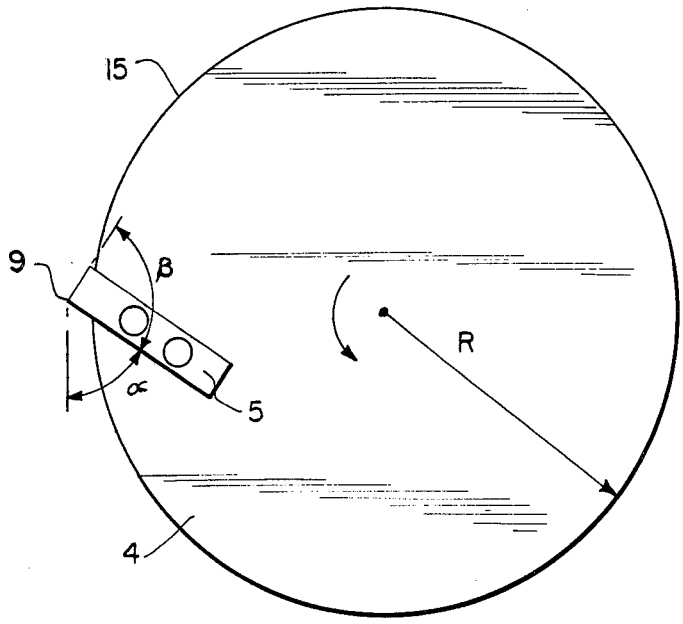
FIG. 3 shows a side view of the tool-holder of the present invention.

The position of the working tool 5 of the test machine relative to the tool holder 4 is shown in FIG. 3. The tool holder 4 has a radius R. The working tool 5 extends 10 mm outside the periphery 15 of the tool-holder 4 and has, as seen from the side, its symmetrical axis at an angle $\alpha$ of 55° at a tangent to the periphery 15. The working tool 5 has a negative cutting angle as its edge angle $\beta$ is 90°.

Figure 4:
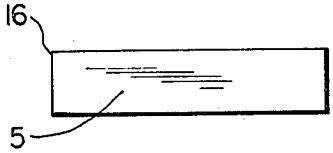
FIG. 4 shows a side view of the working tool of the present invention.
Figure 5:
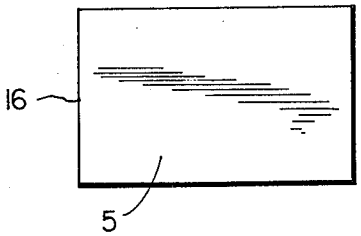
FIG. 5 shows a plan view of the working tool of the present invention.

FIGS. 4 and 5 show a first embodiment of a working tool with a 70 mm wide front edge 16 which was used with the test machine. The tool is shown from the side in FIG. 4 and from the top in FIG. 5.

Figure 6A:
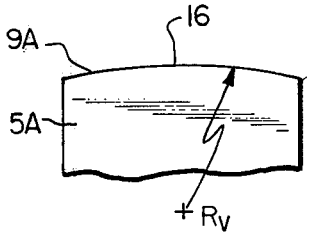
FIG. 6A shows a plan view of an embodiment for the woodmachining edge of the working tool of the present invention.
Figure 6B:
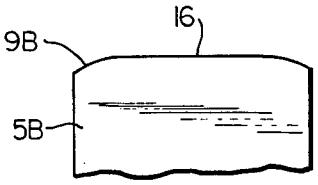
FIG. 6B shows a plan view of another embodiment for the woodmachining edge on the working tool of the present invention.
Figure 6C:
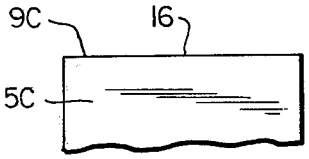
FIG. 6C shows a plan view of a third embodiment for the wood-machining edge on the working tool of the present invention.

FIGS. 6A–6C show three embodiments of working tools for the test machine. The working tools 5A, 5B and 5C are shown with a 50 mm front edge 16. These three working tools 5A, 5B and 5C have different shaped front edges 9A, 9B and 9C, respectively, for wood-machining by shearing stresses. The working tool 5A, has a front edge 9A with a circular design with a large radius Rv of 125 mm (FIG. 6A). Working tool 5B has a front edge with a straight edge but with a radius on the corners (FIG. 6B). Working tool 5C has a front edge 9C with a totally straight edge.

Figure 6D:
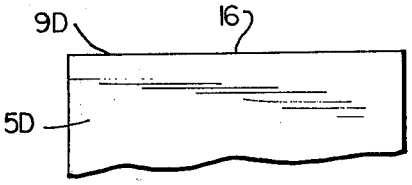
FIG. 6D shows a plan view of a fourth embodiment for the wood-machining edge on the working tool of the present invention.

FIG. 6D shows a working tool 5D for the test machine, with a 70 mm front edge 16. The working tool 5D includes an edge 9D which machines the wood by shearing stresses, this edge is totally straight.

The wood for the production of the long chips is fed by the usual method in a lathe by use of the cross-slide table 13 (FIG. 2). During testing a feeding-rate of 1 or 2 mm/revolution was used (compare the table on page 9). A total of 12 functional tests were carried out in the test machine. The test results are presented in the enclosed table at the end of the specification.

During the first test, workshop dry timber was used which was crumbled to smaller dimensions easier then any other tested timber.

Working tool 5A with a radius edge and tool 5B with rounded corners edge give a shorter chip than tool 5C with a totally straight edge.

The test of knotty timber showed that it could be worked without greater deflections or any other problems.

During some of the tests in the test machine the wood was pushed slightly aside, this was caused by the method of fast-clamping. This was observed to result in higher loose-tearing qualities, even if feeding-capacity was reduced, i.e., more shearing stresses and less working by cutting.

A considerable amount of waste was produced at the bottom edge of the tested material because no support bar was used.

This test machine, according to the present invention, produced during the tests chips with an appearance that must be considered to be consistent with long chips.

Figure 9:
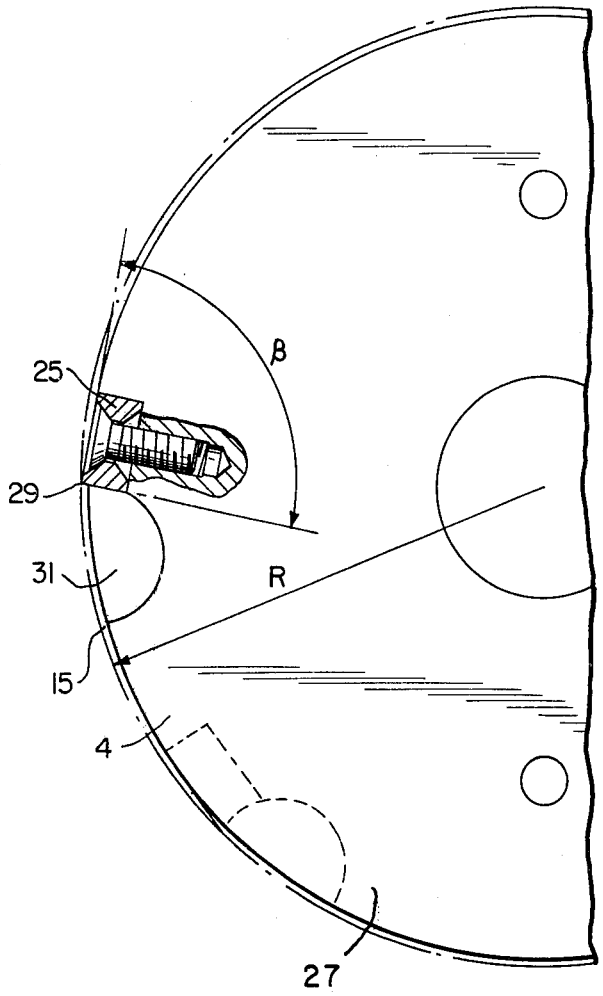
FIG. 9 shows a side view of a part of a tool-holder for the machine according to FIGS. 7 and 8 of the present invention.
Figure 7:
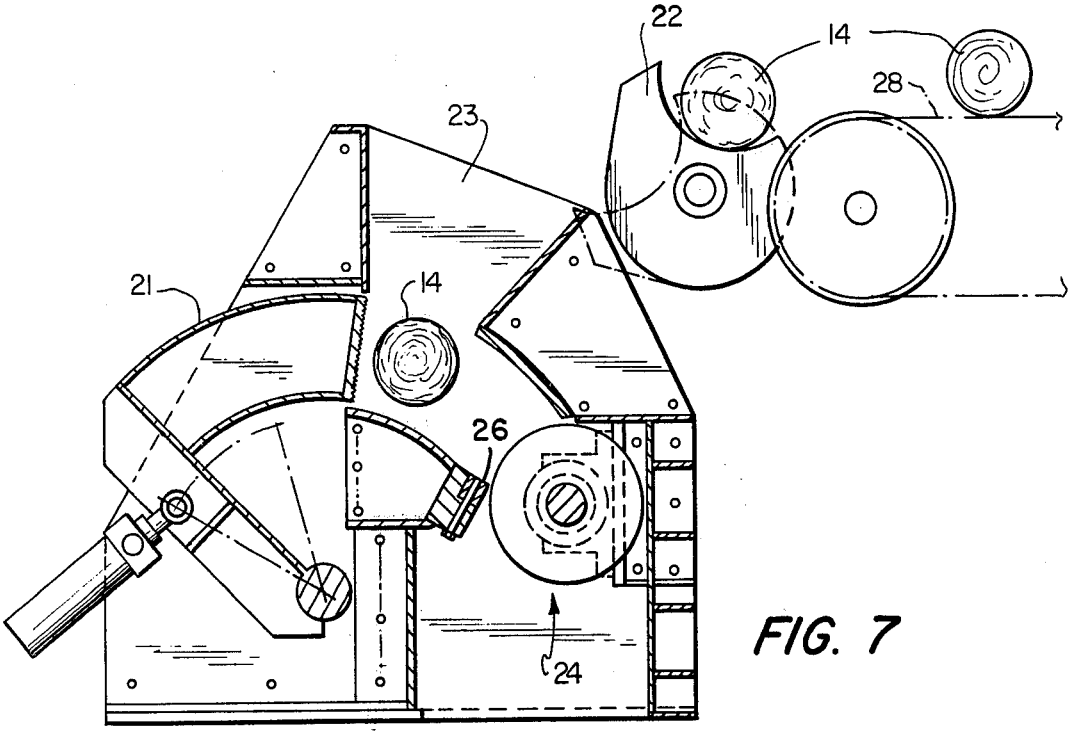
FIG. 7 shows a side view of a machine according to the present invention.
Figure 8:
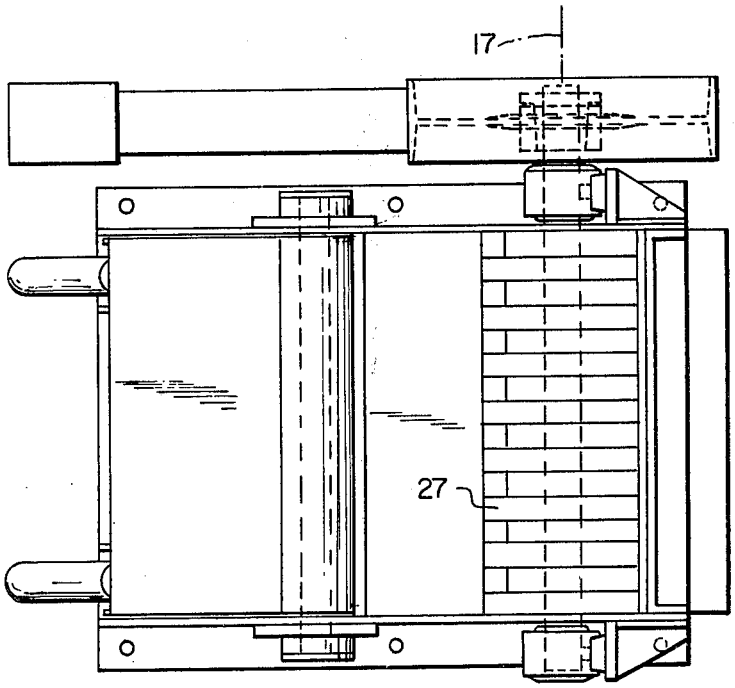
FIG. 8 shows a plan view of the machine according to FIG. 7 of the present invention.

FIGS. 7, 8 and 9 show the construction of the machine according to the present invention, which was developed from the different tests in the test machine. The machine 24 shown in FIGS. 7–9 is equipped with several working tools 25.

The working tool 25 includes a wood-machining edge 29 mounted at the periphery 15 on a rotatable cylinder tool-holder 4 with a radius R. The machine is also equipped with a conical feeding opening 23 for guiding the supply of wood. The feeding device 21 feeds the wood against the edge 29 on the working tool 25.

The machine of the present invention is equipped with a working tool 25 designed for the production of long chips of wood.

Long chips of wood are produced by the design of edge 29 on the working tool 25 which shreds the wood mainly by shearing stresses in the layers of the wood. These layers are mainly positioned between the wood fibers and are approximately parallel with the direction of the fibers. This is further brought about by the form of edge 29 on the shredding tool 25 which is designed with a width mainly agreeing with the width of the long chips.

Long chips of wood are also possible because the edge 29 on the workding tool 25 is chiefly approximately parallel with the rotating shaft 17 of the toolholder 4. A further development has been necessary to make possible the production of long chips in the machine. The feeding device 21 acting in cooperation with the conical feeding opening 23 is designed to feed the wood against the edge 29 on the working tool 25 of the machine, with the direction of the wood fiber approximately parallel with the rotating shaft 17 of the toolholder 4.

FIG. 7 shows an example of a feeding device including a conveyor 28 for the woodstuff which is to be fed to the machine. Between the conveyor 28 and the conical feeding opening 23 and feeding device 21 for feeding in the woodstuff into the machine, a single piece feeder 22 is arranged.

As discussed above, the machine for feeding in the woodstuff into the machine includes a conical feeding opening 23. At the bottom of the opening there is inserted a pivoting, displaceable feeding device 21. The feeding device is displaceable by means of an actuating cylinder, i.e., hydraulic cylinder, towards the lower end of the feeding opening 23, which is open towards the tool-holder 4.

At the bottom of the lower end of the feeding opening 23 adjacent to the tool-holder 4 there is arranged an adjustable dolly rail 26 for the fed woodstuff.

The logs 14 are conveyed to the machine on the belt conveyor 28, with the axis of the logs laying transversely over the conveyor 28. At the end of the conveyor 28 the logs 14 are stopped in front of the single piece feeder 22. The feeder 22 is a turnable cylinder which is formed with a recess in its periphery. When the recess is turned towards the end of the convleyor 28, one log 14 rolls into the recess. The feeder 22 is then rotated in the opposite direction. When the recess comes to the lowest top edge of the opening 23, the log 14 rolls into the feeding opening 23 of the machine. The log 14 rolls downwardly into the opening 23 towards the tool-holder 4. When some logs 14 are assembled in front of the tool-holder 4, the feeding device 21 is pivoted forwards. The logs 14 are thus pressed towards the working tools of the tool-holder 4.

It is to be understood that the actuation of the belt conveyor 28, the single piece feeder 22 and the feeding device 21 may be coordinated to prevent jamming of the logs. The operation of the belt conveyor 28 may be intermittent to control the supply of logs to the single piece feeder 22. The delivery of a log 14 by the single piece feeder 21 and the actuation of the feeding piston 21 may be controlled automatically or may be controlled manually.

The tool-holder 4 of the machine consists of sixteen thin flat circular discs 27, assembled as a unit or packet. Several working tools 25 are mounted round the periphery 15 on each and every disc 27.

As shown in FIG. 9, every disc 27 includes two holes which lie on opposite sides of the center of the disc 27 on a diameter of the disc half way between the center and the periphery of the disc. The flat circular discs 27 are mounted on the rotary shaft 17 of the tool-holder 4. They are assembled as a unit by bolts, which are inserted in these holes in the discs 27.

The positioning of the working tools 25 mounted on the discs 27 is shown in FIG. 9. The working tool 25 is formed as a box-like steel body having a front face and a wood machining edge. It is clamped into a recess in the periphery 15 of one flat circular disc 27 of the toolholder 4 in such a way, that the effective edge 29 of the working tool lies in the region of the periphery of the tool-holder 4.

The tool 25 is fastened to the disc 27 by means of a bolt. The bolt is inserted through a central opening in the working tool 25 and is locked in a radial bore in the disc 27 as is shown in FIG. 9.

Working tool 25 in the machine shown in FIGS. 7–9, is arranged to have a negative cutting angle $\beta$. A negative cutting angle is an angle of 90° or greater.

In the direction of rotation of the tool-holder 4 and adjacent to the working tool 25, are positioned chip-discharge slots 31, which are half-moon-formed hollows in the periphery 15 of the toolholder 4. This is shown in FIGS. 7–9 for the machine of the present invention for long-chip production.

The long chips produced by the machine exit from the space below the tool-holder 4. The long chips produced by the tool 25, when the tool is in contact with the periphery of the log 14 at the upper side of the dolly rail 26, leaves the tool-holder 4 in the discharge slots 31. The tool-holder 4 turns in a counter-clockwise direction as shown in FIG. 7. The long chips produced pass in front of the dolly rail 26 and are assembled in the space below the tool-holder 4.

The tool-holder is rotated at 340 r.p.m. through a speed gear by a 132 Kw motor rotating at 980 r.p.m. The machine produces chips 75 mm long and approximately 4 mm thick, when the wood is fed against the tool-holder 4 at the rate of 8 mm per turn and with a speed of 340 r.p.m. Using the above mentioned data the machine has a capacity of approximately 10 seconds per log when the logs have a length of 1 to 2 meters and a diameter of 300 mm. The return of the feeding piston 21 to its original position is included in the above mentioned capacity caluclations. By changing the speed of the tool-holder 4, the capacity can be varied.

TEST RESULT TABLE

| Test no. | Tool design | Feeding mm/turn | Periphery speed m/sec | Wood type | Test dimensions mm |
|---|---|---|---|---|---|
| 1 | A | 2 | 0.66 | pine | 125 × 125 |
| 2 | B | 2 | " | " | " |
| 3 | B | 2 | " | spruce | 50 × 100 |
| 4 | B | 1 | " | " | " |
| 5 | C | 1 | " | " | 0 (diameter) 150 |
| 6 | C | 2 | " | " | " |
| 7 | D | 1 | " | " | " |
| 8 | D | 1 | " | " | " |
| 9 | D | 1 | " | " | " |
| 10 | D | 1 | " | " | " |
| 11 | D | 1 | " | " | " |
| 12 | D | 1 | 1.54 | " | " |

Comments
1. Workshop dry, somewhat loose in clamping.
2. Workshop dry, somewhat loose in clamping.
3. Green, summer-felled, water stored.
4. Green, summer-felled, water stored.
5. Round timber, green with bark.
6. Round timber, green with bark.
7. Round timber, + somewhat loose in clamping.
8. Round timber, + somewhat loose in clamping.
9. Round timber, + with knots.
10. Round timber, + outer surface on log.
11. Round timber, + outer surface on log.
12. Round timber, + outer surface on log.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A machine provided with at least one wood working tool including a wood machining edge operatively positioned adjacent a device for feeding the wood against said edge, said machine producing long chips of wood consisting of fibers, which are loosened from the wood without cutting through said wood, comprising:

a tool-holder including several thin, flat discs assembled as a unit, each disc including at least two working tools mounted around the periphery of said disc, said tool-holder being positioned on a rotary shaft;

a wood machining edge on said working tool of a width comparable with the width of said long chips;

said wood machining edge being approximately parallel with said rotary shaft of the tool-holder;

said working tool including a front face and a wood machining edge and forming an angle therebetween said angle being a negative cutting angle, an angle of ninety degrees or greater; and a device for feeding the wood against said edge with the longitudinal direction of the wood fiber substantially parallel to said rotary shaft of the tool-holder and the wood machining edge of said working tools;

whereby the fibers formed as long chips of the wood are loosened along their whole length mainly by shearing stresses in layers, which are mainly positioned between the wood fibers and which are approximately parallel with the direction of the fibers.

2. A machine according to claim 1, wherein the device for feeding the wood to the machine consists of a feeding duct with a funnel pointing in the feeding direction, in which a feeding device is mounted to feed the wood against the tool-holder at the discharge opening of the feeding duct.

3. A machine according to claim 1, wherein the edge on the working tool is circular with a large radius.

4. A machine according to claim 1, wherein the edge on the working tool is mainly straight with rounded corners.

5. A machine according to claim 1, wherein the edge on the working tool is totally straight.

6. A machine according to claim 1, wherein a chip discharge slot is formed on the tool-holder in front of the working tool as viewed in the direction of rotation of the tool-holder.

* * * * *